US010399822B2

(12) United States Patent
Zhu et al.

(10) Patent No.: US 10,399,822 B2
(45) Date of Patent: Sep. 3, 2019

(54) HYDRAULIC ELEVATING PLATFORM HAVING NO GUIDE RAILS AND ELEVATING METHOD

(71) Applicants: Dongnan Elevator Co., Ltd., Jiangsu (CN); China University of Mining and Technology, Jiangsu (CN)

(72) Inventors: Zhencai Zhu, Jiangsu (CN); Guohua Cao, Jiangsu (CN); Jiancong Qin, Jiangsu (CN); Panda Wang, Jiangsu (CN); Weihong Peng, Jiangsu (CN); Lingyun Ma, Jiangsu (CN); Yiping Ma, Jiangsu (CN); Ming Gao, Jiangsu (CN); Jianrong Yang, Jiangsu (CN); Lei Wei, Jiangsu (CN)

(73) Assignee: Dongnan Elevator Co., Ltd., Jiangsu (CN)

( * ) Notice: Subject to any disclaimer, the term of this patent is extended or adjusted under 35 U.S.C. 154(b) by 226 days.

(21) Appl. No.: 15/542,601

(22) PCT Filed: Dec. 29, 2015

(86) PCT No.: PCT/CN2015/099315
§ 371 (c)(1),
(2) Date: Jul. 10, 2017

(87) PCT Pub. No.: WO2017/088252
PCT Pub. Date: Jun. 1, 2017

(65) Prior Publication Data
US 2018/0170716 A1 Jun. 21, 2018

(30) Foreign Application Priority Data
Nov. 27, 2015 (CN) ..... 2015 1 0847654

(51) Int. Cl.
*B66B 9/04* (2006.01)
*B66B 7/02* (2006.01)
(Continued)

(52) U.S. Cl.
CPC ..... *B66B 9/04* (2013.01); *B66B 7/027* (2013.01); *B66B 11/006* (2013.01);
(Continued)

(58) Field of Classification Search
CPC ..... B66B 9/04; B66B 7/027; B66B 11/006; B66B 11/028; E04F 11/0201; F15B 11/20; F15B 15/1428; F15B 2211/7107
See application file for complete search history.

(56) References Cited

U.S. PATENT DOCUMENTS 3,419,161 A * 12/1968 Hagel ..... B66B 9/00 187/250
3,534,664 A * 10/1970 Ulinski ..... B66F 9/08 187/226
(Continued)

FOREIGN PATENT DOCUMENTS

CN 201176677 Y 1/2009
CN 101746690 A 6/2010
(Continued)

OTHER PUBLICATIONS

PCT International Search Report, PCT/CN2015/099315, dated Sep. 1, 2016, with English Translation.
(Continued)

*Primary Examiner* — Michael A Riegelman
(74) *Attorney, Agent, or Firm* — TraskBritt

(57) ABSTRACT

A hydraulic elevating platform having no guide rails and an elevating method. A hydraulic power pack drives three parallel hydraulic cylinders to work synchronously, thereby
(Continued)

implementing the rising and falling of an elevating platform; when the elevating platform reaches a predetermined floor, an upper electric pushrod pushes a pedal assembly out, and then the pedal assembly drives a pedal to rise by means of a pedal elevating system until the pedal is flush with the surface of a loading table of the elevating platform; outward-swinging doors between the elevating platform and a floor open to form pedal guardrails; then sliding doors open and a man can step onto a stair via the pedal assembly. An eccentric loading adjusting means eliminates eccentric loading to achieve balance about the center of gravity, thereby eliminating the eccentric loading of the platform. The elevating platform is simple in structure, safe, reliable, and easy to maintain. The elevating platform, placed within a spiral stair, is convenient for movement of crowds and cargo delivery at certain scenarios and is widely applicable. The elevating method is simple to implement and effectively solves the eccentric loading problem caused by reasons such as outstretching of a pedal of a hydraulic elevating platform and uneven distribution of people on the elevating platform, so that the hydraulic elevating platform is more stable and reliable during operation.

18 Claims, 5 Drawing Sheets

(51) Int. Cl.

| | |
|---|---|
| ***B66B 11/00*** | (2006.01) |
| ***B66B 11/02*** | (2006.01) |
| ***E04F 11/02*** | (2006.01) |
| *F15B 11/20* | (2006.01) |
| *F15B 15/14* | (2006.01) |

(52) U.S. Cl.
CPC ..... *B66B 11/028* (2013.01); *E04F 11/0201* (2013.01); *F15B 11/20* (2013.01); *F15B 15/1428* (2013.01); *F15B 2211/7107* (2013.01)

(56) References Cited

U.S. PATENT DOCUMENTS

| | | | | | |
|---|---|---|---|---|---|
| 4,363,380 | A * | 12/1982 | Rued | B66B 9/04 | 187/274 |
| 4,683,988 | A * | 8/1987 | Shrum, Jr. | B66F 9/08 | 187/234 |
| 5,052,520 | A * | 10/1991 | Wakamiya | B66F 7/18 | 187/215 |
| 5,129,483 | A * | 7/1992 | Nussbaum | B66F 7/20 | 187/213 |
| 5,339,925 | A * | 8/1994 | Price | B66F 7/04 | 187/206 |
| 5,636,713 | A * | 6/1997 | Perkins | B66B 9/04 | 187/226 |
| 5,848,670 | A * | 12/1998 | Salzman | B66F 7/00 | 187/272 |
| 6,026,934 | A * | 2/2000 | Deurloo | B66B 9/04 | 187/274 |
| 6,719,099 | B2 * | 4/2004 | Lamb | B66B 9/04 | 187/272 |
| 7,028,811 | B2 * | 4/2006 | Rauch | B66F 7/02 | 187/205 |
| 7,758,103 | B1 * | 7/2010 | Steury | B60P 3/34 | 296/156 |
| 2011/0127115 | A1 * | 6/2011 | Stannah | B66B 9/04 | 187/272 |
| 2013/0313041 | A1 * | 11/2013 | Bonetti | E04F 11/0201 | 182/18 |
| 2018/0170716 | A1 * | 6/2018 | Zhu | B66B 7/027 | |

FOREIGN PATENT DOCUMENTS

| | | | |
|---|---|---|---|
| CN | 205187567 | U | 4/2016 |
| DE | 102005003283 | A1 | 9/2006 |
| JP | 2005154141 | A | 6/2005 |
| JP | 2005187206 | A | 7/2005 |
| JP | 3957724 | B2 | 8/2007 |
| WO | 2017088252 | A1 | 6/2017 |

OTHER PUBLICATIONS

PCT International Written Opinion, PCT/CN2015/099315, dated Sep. 1, 2016.

* cited by examiner

HYDRAULIC ELEVATING PLATFORM HAVING NO GUIDE RAILS AND ELEVATING METHOD

CROSS-REFERENCE TO RELATED APPLICATIONS

This application is a national phase entry under 35 U.S.C. § 371 of International Patent Application PCT/CN2015/099315, filed Dec. 29, 2015, designating the United States of America and published as International Patent Publication WO 2017/088252 A1 on Jun. 1, 2017, which claims the benefit under Article 8 of the Patent Cooperation Treaty to Chinese Patent Application Serial No. 201510847654.2, filed Nov. 27, 2015.

TECHNICAL FIELD

This application relates to a rail-free hydraulic lifting platform and lifting method, which are applicable in the interior of spiral staircases.

BACKGROUND

Spiral staircases are commonly referred to helical or screw type staircases. Spiral staircases are favored widely due to their streamlined and attractive appearance, elegance, outstanding decorative effect, small footprint, and are applied more and more in large-size public buildings such as museums and stores, as well as homes with space restrictions.

As technology develops, the application of elevators brought great convenience to people's lives and has become a trend in buildings in the social architecture nowadays. Elevators play an important role in vertical transport of persons and equipment. Owing to the structural characteristics of spiral staircase, an elevator shaft cannot be installed for a spiral staircase in the same way as ordinary elevators, and usually it is unable to arrange an elevator motor room on the roof of building. Therefore, an ordinary traction elevator cannot meet the requirements. In order to meet the requirements for sight-seeing, comfortability, and convenient vertical transport of persons and articles, it is an urgent task to design a lifting platform that is applicable to a spiral staircase environment.

BRIEF SUMMARY

In order to overcome the drawbacks in the prior art, the apparatus disclosed herein provides a rail-free hydraulic lifting platform that is simple and compact in structure, safe and reliable, and can be used conveniently for vertical transport of persons and articles. In addition, the present application further provides a lifting method for a platform applicable in a spiral staircase, which is simple, easy to operate, and convenient to run and manage.

The disclosed apparatus employs the following technical solution:

a rail-free hydraulic lifting platform, comprising a hydraulic pump station, and three parallel hydraulic cylinders and a lifting platform arranged on the floor within a spiral staircase, wherein, the three parallel hydraulic cylinders are arranged in an equilateral triangle layout and the lifting platform is fixed to the top of the three parallel hydraulic cylinders;

the lifting platform comprises a bearing platform, which is provided with handrails on its top part, an annular door and an outward-swinging door arranged at its entrance and exit, and an upper truss fixedly connected to its bottom part; an intermediate truss and a lower truss are arranged in parallel to each other below the upper truss, a platform transition device is arranged on the top part of the intermediate truss, and an eccentric load adjusting device is arranged on the top part of the lower truss; the upper truss, intermediate truss, and lower truss are fixedly connected via vertical support plates;

the platform transition device comprises an upper supporting guide frame and an upper electric push rod fixedly connected to the top part of the upper supporting guide frame, and a footstep assembly is hinged to the right end of the upper electric push rod; the footstep assembly can move on the top part of the upper supporting guide frame in an extending/retracting direction of the upper electric push rod and has a lifting mechanism arranged on it;

the eccentric load adjusting device comprises a servo motor and a rotating platform, wherein the rotating platform is connected to the servo motor and has a lower supporting guide frame arranged above it; the lower supporting guide frame has a lower electric push rod fixedly connected to its top part, an eccentric load counterweight is hinged to the right end of the lower electric push rod, and the eccentric load counterweight can move on the lower supporting guide frame in an extending/retracting direction of the lower electric push rod; rollers are mounted on the bottom of the lower supporting guide frame, and can roll along a circular guide rail fixedly connected to the lower truss.

Preferably, the eccentric load counterweight comprises counterweight blocks mounted on a frame, wheels are arranged on the bottom of the frame, and the wheels are laid on the supporting guide frame.

As a further improved solution of this disclosure, guardrails are provided at the landings where the lifting platform is to be docked, so as to ensure that the persons can get on and off the lifting platform safely.

As a further improved solution of the disclosed apparatus, in order to prevent the plungers of the hydraulic cylinders from being exposed to the outside, thus degrading both the aesthetics and safety, telescoping sleeve protection covers are arranged between the bottom of the lifting platform and a foundation, with the bottom part of the telescoping sleeve protection covers fixed to the foundation, and the top part of the telescoping sleeve protection covers connected to the bottom of the lifting platform.

Furthermore, in order to strengthen the stability of the parallel hydraulic cylinders, a triangular reinforcement frame is fitted over the three parallel hydraulic cylinders, and the top surface of the triangular reinforcement frame is fixedly connected to the bottom surface of the lower truss.

This disclosure further provides a lifting method of the rail-free hydraulic lifting platform, including the following steps:

(1) Driving the three parallel hydraulic cylinders to move synchronously via the hydraulic pump station, so that the lifting platform is equally lifted smoothly and steadily;

(2) When the lifting platform reaches to a predetermined floor, pushing out the footstep assembly on the bottom of the lifting platform by means of the upper electric push rod, and then lifting up the footsteps by means of the lifting mechanism in the footstep assembly so that the footsteps are flush with the surface of the bearing platform of the lifting platform, and, at that moment, opening the outward-swinging door between the lifting platform and the floor to form guardrails;

(3) Opening the annular door so that the persons can move in or out safely, after the actions of the footstep assembly and the outward-swinging door are completed; in view that a non-uniform distribution of weight or persons on the bearing platform may cause the center of gravity of the system to deviate from the center of the bearing platform, starting the servo motor to drive the rotating platform to rotate when a pressure sensor arranged on the lifting platform detects the deviation from the center of gravity, so that the rotating platform drives the lower supporting guide frame connected to it to rotate, and thereby the rollers on the bottom of the lower supporting guide frame roll along the circular guide rail fixedly connected to the lower truss and the lower supporting guide frame rotates around the center of rotation to an angle corresponding to a direction opposite to the deviation position of the center of gravity;

(4) Driving the eccentric load counterweight to move by means of the lower electric push rod, so that the counterweight blocks are driven by the wheels to move in the extending/retracting direction of the lower electric push rod, thereby balancing the center of gravity is balanced and eliminating the eccentric load of the platform.

The rail-free hydraulic lifting platform provided in this disclosure is disposed in a spiral staircase; in such a case, three parallel hydraulic cylinders are driven by a hydraulic pump station to move synchronously so that the lifting platform is lifted up and down; when the lifting platform reaches to a predetermined floor, the footstep assembly on the bottom of the lifting platform is pushed out by the upper electric push rod, and then the footsteps are lifted up by the footstep lifting mechanism in the footstep assembly so that they are flush with the lifting platform; next, the outward-swinging door between the lifting platform and the floor is opened to form footstep guardrails; after the actions of the footstep assembly and the outward-swinging door are completed, the annular door is opened, and the persons can move in or out safely now; the eccentric load adjusting device may be started to eliminate an eccentric load resulted from outward-extension of the footsteps from the hydraulic lifting platform or non-uniform distribution of the persons on the platform, so that the center of gravity is balanced and the eccentric load of the platform is eliminated. Compared to the prior art, the platform and method provided in this disclosure solve the problem of eccentric load resulted from outward-extension of the footsteps from the hydraulic lifting platform or non-uniform distribution of persons and cargo on the lifting platform; thus, the hydraulic lifting platform can operate more stably and reliably. The entire system is simple in structure, can be arranged in a spiral staircase, and is safe and reliable; the lifting method is simple to implement, easy to operate and maintain, convenient for transport of persons at certain scenarios and widely applicable.

Figure 1:
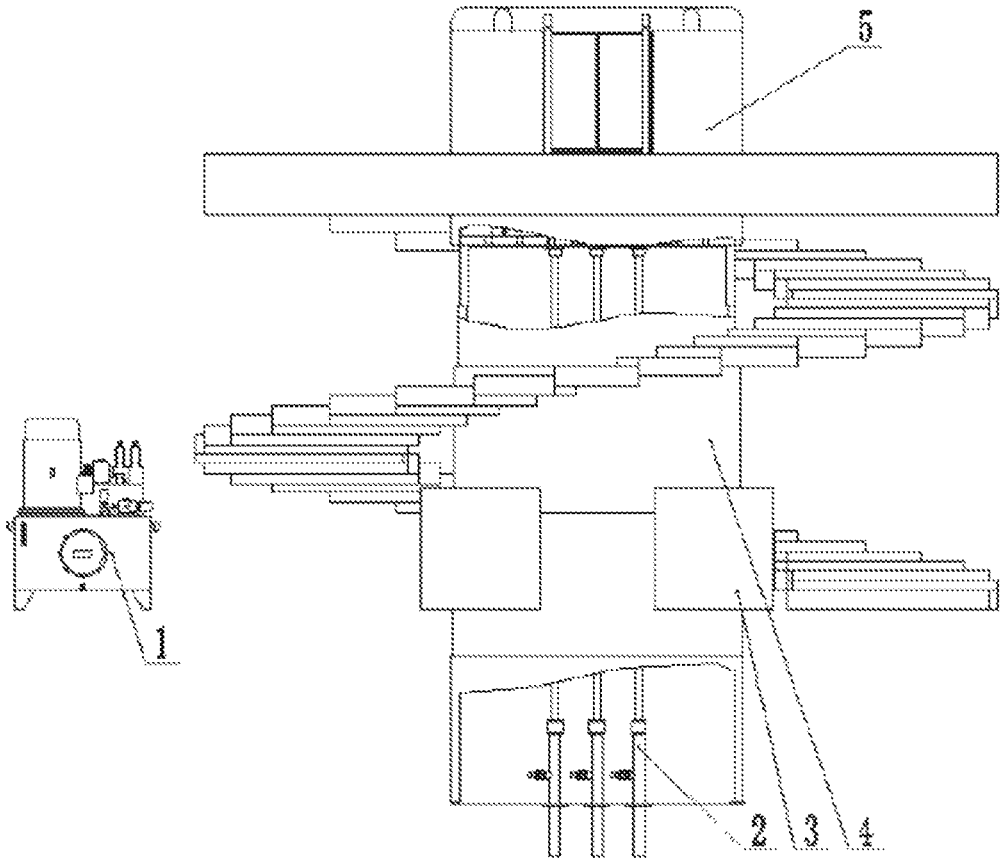
FIG. 1 is a front view of installation of the entire hydraulic lifting platform according to the disclosure.

In the figures: hydraulic pump station 1; parallel hydraulic cylinders 2; guardrails 3; telescoping sleeve protection covers 4; lifting platform 5; triangular fixing frame 6; handrails 5-1; bearing platform 5-2; annular door 5-3; outward-swinging door 5-4; upper truss 5-5; platform transition device 5-6; intermediate truss 5-7; lower truss 5-8; eccentric load adjusting device 5-9; vertical support plate 5-10; upper supporting guide frame 5-11; upper electric push rod 5-12; footstep assembly 5-13; servo motor 5-14; rotating platform 5-15; lower supporting guide frame 5-16; lower electric push rod 5-17; circular guide rail 5-19; roller 5-20; counterweight block 5-21; counterweighted frame 5-22; and counterweighted wheels 5-23.

DETAILED DESCRIPTION

Figure 2:
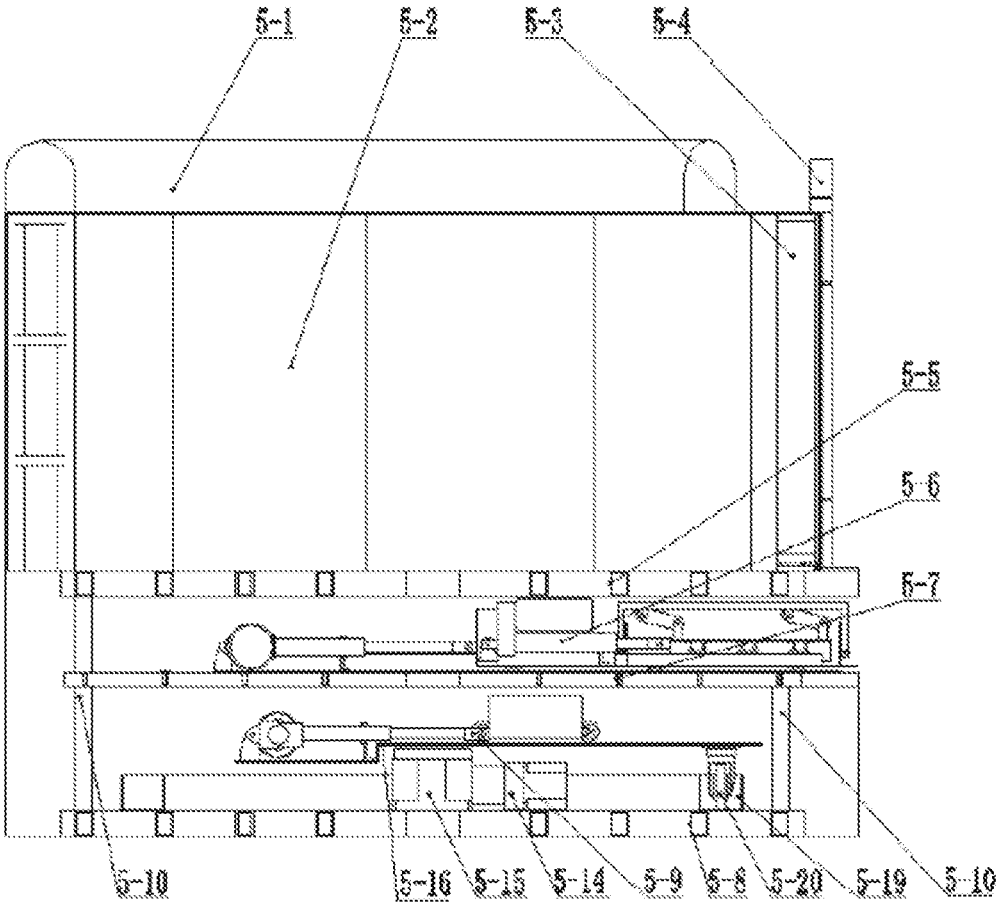
FIG. 2 is a front view of the lifting platform according to this disclosure.
Figure 3:
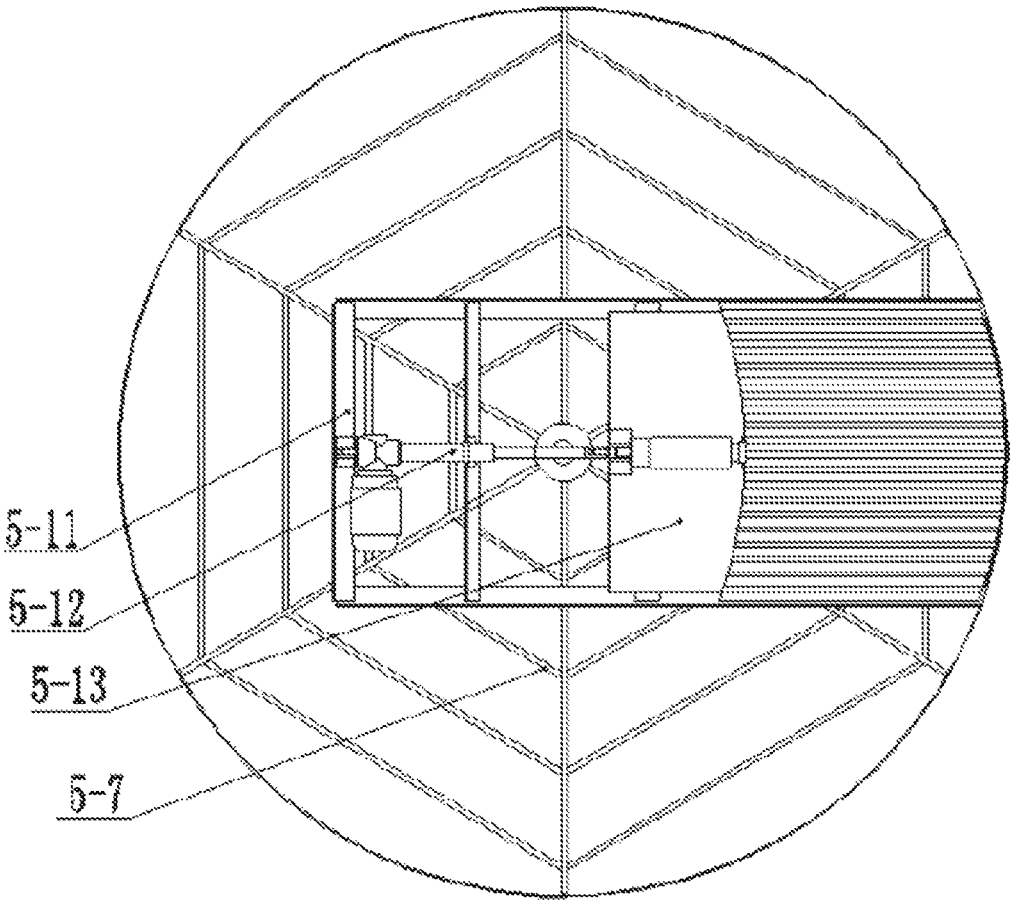
FIG. 3 is a top view of the platform transition device according to the disclosure.
Figure 4:
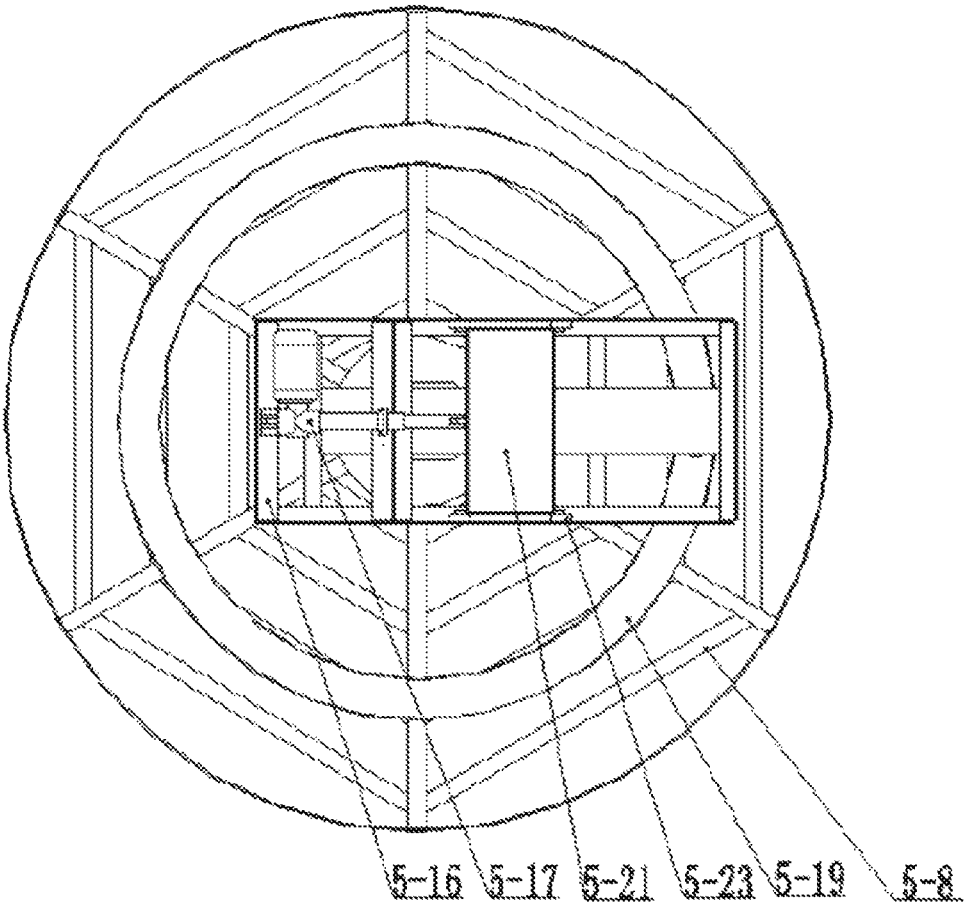
FIG. 4 is a top view of the eccentric load adjusting device according to this disclosure.
Figure 5:
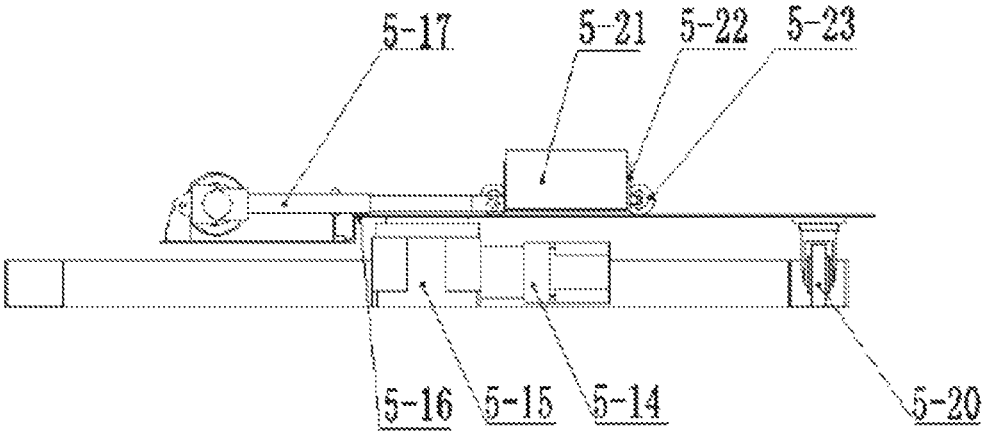
FIG. 5 is a front view of the eccentric load adjusting device according to the disclosure.

Hereunder, this disclosure will be further detailed, with reference to the accompanying drawings:

As shown in FIG. 1, the rail-free hydraulic lifting platform provided in the disclosure comprises a hydraulic pump station 1 arranged in a machine room, three parallel hydraulic cylinders 2 and a lifting platform 5 arranged on the floor in a spiral staircase, wherein, the three parallel hydraulic cylinders 2 are arranged in an equilateral triangle layout, and the lifting platform 5 is fixed to the top of the three parallel hydraulic cylinders 2;

As shown in FIG. 2, the lifting platform 5 comprises a bearing platform 5-2, which is provided with handrails 5-1 on its top part, an annular door 5-3 and an outward-swinging door 5-4 arranged at its entrance and exit, and an upper truss 5-5 fixedly connected to its bottom part; an intermediate truss 5-7 and a lower truss 5-8 are arranged in parallel to each other below the upper truss 5-5, a platform transition device 5-6 is arranged on the top part of the intermediate truss 5-7, and an eccentric load adjusting device 5-9 is arranged on the top part of the lower truss 5-8; the upper truss 5-5, intermediate truss 5-7, and lower truss 5-8 are fixedly connected via vertical support plates 5-10;

As shown in FIGS. 2 and 3, the platform transition device 5-6 comprises an upper supporting guide frame 5-11 and an upper electric push rod 5-12 fixedly connected to the top part of the upper supporting guide frame 5-11, and a footstep assembly 5-13 is hinged to the right end of the upper electric push rod 5-12; the footstep assembly 5-13 can move on the top part of the upper supporting guide frame 5-11 in an extending/retracting direction of the upper electric push rod 5-12, and has a lifting mechanism arranged in it;

As shown in FIGS. 2, 4 and 5, the eccentric load adjusting device 5-9 comprises a servo motor 5-14 and a rotating platform 5-15, wherein, the rotating platform 5-15 is connected to the servo motor 5-14 and has a lower supporting guide frame 5-16 arranged above it; the lower supporting guide frame 5-16 has a lower electric push rod 5-17 fixedly connected to its top part, an eccentric load counterweight is hinged to the right end of the lower electric push rod 5-17, and the eccentric load counterweight can move on the lower supporting guide frame 5-16 in an extending/retracting direction of the lower electric push rod 5-17; rollers 5-20 are mounted on the bottom of the lower supporting guide frame 5-16, and can roll along a circular guide rail 5-19 fixedly connected to the lower truss 5-8.

Preferably, the eccentric load counterweight comprises counterweight blocks 5-21 mounted on a counterweighted frame 5-22, counterweighted wheels 5-23 are arranged on the bottom of the counterweighted frame 5-22, and the counterweighted wheels 5-23 are laid on the supporting guide frame 5-16.

As a further improved solution of this disclosure, guardrails 3 are provided at the landings where the lifting platform 5 is to be docked.

As a further improved solution of this disclosure, telescoping sleeve protection covers 4 are arranged between the bottom of the lifting platform 5 and a foundation, the bottom part of the telescoping sleeve protection covers 4 is fixed to the foundation, and the top part of the telescoping sleeve protection covers 4 is connected to the bottom of the lifting platform 5.

Figure 6:
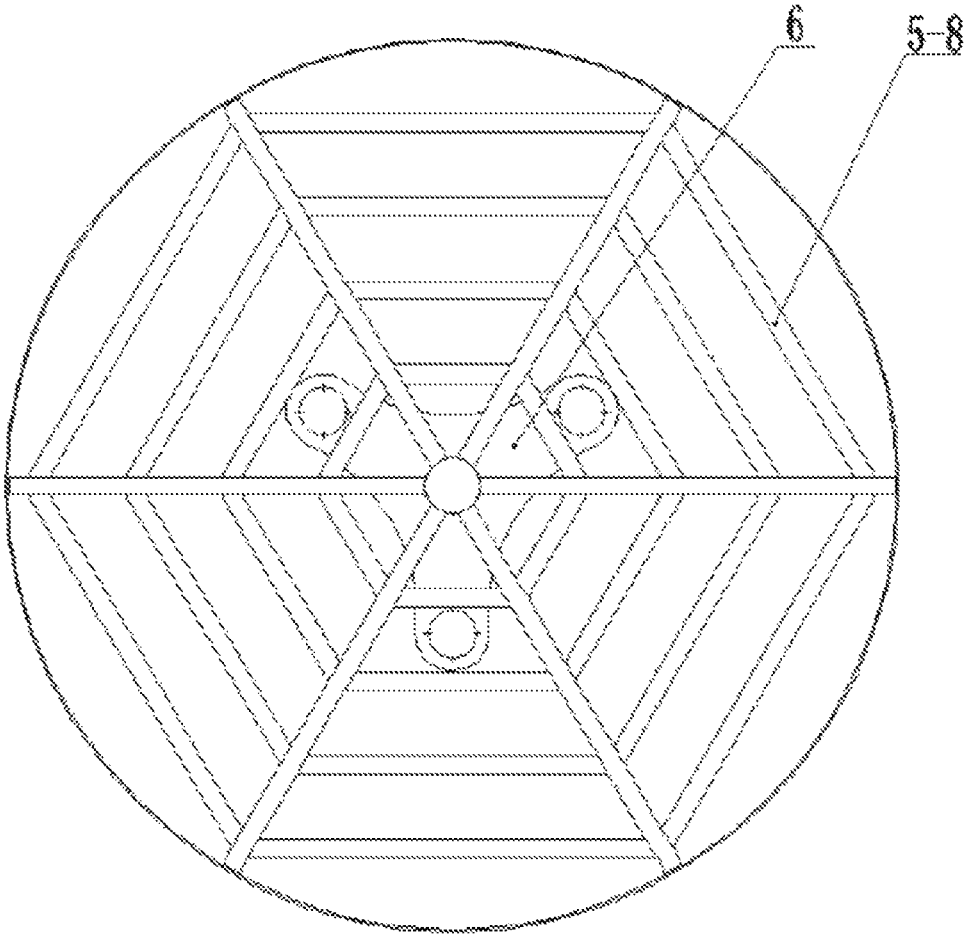
FIG. 6 is a top view of the lower truss according to the disclosure.

Furthermore, as shown in FIG. 6, in order to strengthen the stability of the parallel hydraulic cylinders, a triangular fixing frame 6 is fitted over the three parallel hydraulic cylinders 2, and the top surface of the triangular fixing frame 6 is welded to the bottom surface of the lower truss 5-8.

The lifting method of the rail-free hydraulic lifting platform is as follows:

(1) In the rail-free hydraulic lifting platform according to the disclosure, the three parallel hydraulic cylinders 2 are driven by the hydraulic pump station 1 to move synchronously, the relative positions of the three parallel hydraulic cylinders are fixed by means of the triangular fixing frame 6; thus, the stability is strengthened, and the lifting platform 5 can be lifted up smoothly and steadily; the guardrails 3 ensure that the persons can move in or out safely, the bottom part of the telescoping sleeve protection covers 4 is fixed to the foundation, the top part of the telescoping sleeve protection covers 4 is connected to the bottom of the lifting platform 5 and extends or retracts as the lifting platform 5 is lifted up or lowered down, in order to prevent the plungers of the hydraulic cylinders from being exposed to the outside to degrade the aesthetics and safety.

(2) When the lifting platform 5 reaches to a predetermined floor, the footstep assembly 5-13 on the bottom of the lifting platform 5 is pushed out by the upper electric push rod 5-12, and then the footsteps are lifted up by means of the lifting mechanism in the footstep assembly 5-13 so that the footsteps are flush with the surface of the bearing platform 5-2, and, at that moment, the outward-swinging door 5-4 between the lifting platform 5 and the floor is opened to form guardrails.

(3) After the actions of the footstep assembly 5-13 and the outward-swinging door 5-4 are completed, the annular door 5-3 is opened, and the persons can walk upstairs from the lifting platform 5 via the footstep assembly 5-13; a non-uniform distribution of the persons on the bearing platform 5-2 may cause the center of gravity of the system to deviate from the center of the bearing platform 5-2; when a pressure sensor arranged on the lifting platform 5 detects deviation of the center of gravity, the eccentric load is eliminated by means of the eccentric load adjusting device 5-9. The servo motor 5-14 is started to drive the rotating platform 5-15 to rotate, so that the rotating platform 5-15 drives the lower supporting guide frame 5-16 connected to it to rotate, the rollers 5-20 on the bottom of the lower supporting guide frame 5-16 roll along the circular guide rail 5-19 fixedly connected to the lower truss 5-8, and the lower supporting guide frame 5-16 rotates around the center of rotation to an angle corresponding to a direction opposite to the deviation position of the center of gravity.

(4) The eccentric load counterweight is driven by the lower electric push rod 5-17 to move, so that the counterweight blocks 5-21 are driven by the counterweighted wheels 5-23 to move in the extending/retracting direction of the lower electric push rod 5-17, and thereby the center of gravity is balanced and the eccentric load of the bearing platform 5-2 is eliminated.

The invention claimed is:

1. A rail-free hydraulic lifting platform, comprising a hydraulic pump station, and three parallel hydraulic cylinders and a lifting platform arranged on the floor in a spiral staircase, the three parallel hydraulic cylinders are arranged in an equilateral triangle layout, and the lifting platform is fixed to the top of the three parallel hydraulic cylinders;

the lifting platform comprises a bearing platform, which is provided with handrails on its top part, an annular door and an outward-swing door arranged at its entrance and exit, and an upper truss fixedly connected to its bottom part; an intermediate truss and a lower truss are arranged in parallel to each other below the upper truss, a platform transition device is arranged on the top part of the intermediate truss, and an eccentric load adjusting device is arranged on the top part of the lower truss; the upper truss, intermediate truss, and lower truss are fixedly connected via vertical support plates;

the platform transition device comprises an upper supporting guide frame and an upper electric push rod fixedly connected to the top part of the upper supporting guide frame, and a footstep assembly is hinged to the right end of the upper electric push rod, the footstep assembly can move on the top part of the upper supporting guide frame in an extending/retracting direction of the upper electric push rod, and has a lifting mechanism arranged in it;

the eccentric load adjusting device comprises a servo motor and a rotating platform, the rotating platform is connected to the servo motor and has a lower supporting guide frame arranged above it; the lower supporting guide frame has a lower electric push rod fixedly connected to its top part, an eccentric load counterweight is hinged to the right end of the lower electric push rod, and the eccentric load counterweight can move on the lower supporting guide frame in an extending/retracting direction of the lower electric push rod; rollers are mounted on the bottom of the lower supporting guide frame, and can roll along a circular guide rail fixedly connected to the lower truss.

2. The rail-free hydraulic lifting platform according to claim 1, wherein the eccentric load counterweight comprises counterweight blocks mounted on a counterweight frame, counterweight wheels are arranged on the bottom of the counterweight frame, and the counterweight wheels are laid on the lower supporting guide frame.

3. The rail-free hydraulic lifting platform of claim 2, further comprising:

guardrails provided at landings where the lifting platform is docked.

4. The rail-free hydraulic lifting platform of claim 2, wherein telescopic sleeve protection covers are arranged between the bottom of the lifting platform and a foundation, wherein the bottom part of a sleeve protection cover is fixed to the foundation, and wherein the top part of the sleeve protection covers is connected to the bottom of the lifting platform.

5. The rail-free hydraulic lifting platform of claim 2, further comprising:

a triangular fixing frame fitted over the three parallel hydraulic cylinders, and wherein the top surface of the triangular fixing frame is fixedly connected to the bottom surface of the lower truss.

6. The rail-free hydraulic lifting platform according to claim 1, wherein guardrails are provided at landings where the lifting platform is to be docked.

7. The rail-free hydraulic lifting platform according to claim 1, wherein telescopic sleeve protection covers are arranged between the bottom of the lifting platform and a foundation, the bottom part of the sleeve protection covers is fixed to the foundation, and the top part of the sleeve protection covers is connected to the bottom of the lifting platform.

8. The rail-free hydraulic lifting platform according to claim 1, wherein a triangular fixing frame is fitted over the three parallel hydraulic cylinders, and the top surface of the triangular fixing frame is fixedly connected to the bottom surface of the lower truss.

9. A method of using the rail-free hydraulic lifting platform of claim 1, the method comprising:

driving the three parallel hydraulic cylinders to move synchronously via the hydraulic pump station, so that the lifting platform is lifted smoothly and steadily;

when the lifting platform reaches a predetermined floor, pushing out the footstep assembly arranged on the bottom of the lifting platform by means of the upper electric push rod, and then lifting up the footsteps by means of the lifting mechanism in the footstep assembly so that the footsteps are flush with the surface of the bearing platform, and, at that moment, opening the outward-swing door between the lifting platform and the floor to form guardrails;

opening the annular door after the actions of the footstep assembly and the outward-swing door are completed, so that a person can walk upstairs from the lifting platform via the footstep assembly; starting the servo motor to drive the rotating platform to rotate when a pressure sensor arranged on the lifting platform detects the deviation of the center of gravity, so that the rotating platform drives the lower supporting guide frame connected to it to rotate, and thereby the rollers on the bottom of the lower supporting guide frame roll along the circular guide rail fixedly connected to the lower truss and the lower supporting guide frame rotates around the center of rotation to an angle corresponding to a direction opposite to the deviation position of the center of gravity; and driving the eccentric load counterweight by means of the lower electric push rod to move, so that the counterweight blocks are driven by the counterweight wheels to move in the extending/retracting direction of the lower electric push rod, and thereby the center of gravity is balanced and the eccentric load of the platform is eliminated.

10. The hydraulic lifting platform of claim 1, wherein the eccentric load counterweight comprises counterweight blocks mounted on a counterweight frame, counterweight wheels are arranged on the bottom of the counterweight frame, and the counterweight wheels are laid on the lower supporting guide frame.

11. The hydraulic lifting platform of claim 10, further comprising: guardrails provided at landings where the lifting platform is docked.

12. The hydraulic lifting platform of claim 10, wherein telescopic sleeve protection covers are arranged between the bottom of the lifting platform and a foundation, wherein the bottom part of a sleeve protection cover is fixed to the foundation, and wherein the top part of the sleeve protection covers is connected to the bottom of the lifting platform.

13. The hydraulic lifting platform of claim 10, further comprising:

a triangular fixing frame fitted over the three parallel hydraulic cylinders, and wherein the top surface of the triangular fixing frame is fixedly connected to the bottom surface of the lower truss.

14. A hydraulic lifting platform comprising:

a hydraulic pump station, three parallel hydraulic cylinders arranged in an equilateral triangle layout, and a lifting platform arranged on the floor in a spiral staircase and fixed to the top of the three parallel hydraulic cylinders, wherein the lifting platform comprises:

a bearing platform having handrails on its top part, an annular door and an outward-swinging door arranged at its entrance and exit, an upper truss fixedly connected to its bottom part;

an intermediate truss and a lower truss arranged in parallel to one another below the upper truss, a platform transition device arranged on the top part of the intermediate truss, and an eccentric load adjusting device arranged on the top part of the lower truss;

wherein the upper truss, intermediate truss, and lower truss are fixedly connected to the lifting platform via support plates;

wherein the platform transition device comprises:

an upper supporting guide frame and an upper electric push rod fixedly connected to the top part of the upper supporting guide frame, and a footstep assembly hinged to the end of the upper electric push rod, so that the footstep assembly can move on the top part of the upper supporting guide frame in an extending/retracting direction of the upper electric push rod, and has a lifting mechanism arranged in it;

wherein the eccentric load adjusting device comprises a servo motor and a rotating platform, the rotating platform connected to the servo motor and arranged below a lower supporting guide frame; the lower supporting guide frame having a lower electric push rod fixedly connected to its top part, an eccentric load counterweight hinged to the end of the lower electric push rod, and the eccentric load counterweight moves on the lower supporting guide frame in an extending/retracting direction of the lower electric push rod; and wherein rollers are mounted on the bottom of the lower supporting guide frame, and are able to roll along a circular guide rail fixedly connected to the lower truss.

15. The hydraulic lifting platform of claim 14, further comprising: guardrails provided at landings where the lifting platform is docked.

16. The hydraulic lifting platform of claim 14, wherein telescopic sleeve protection covers are arranged between the bottom of the lifting platform and a foundation, wherein the bottom part of a sleeve protection cover is fixed to the foundation, and wherein the top part of the sleeve protection covers is connected to the bottom of the lifting platform.

17. The hydraulic lifting platform of claim 14, further comprising:

a triangular fixing frame fitted over the three parallel hydraulic cylinders, and wherein the top surface of the triangular fixing frame is fixedly connected to the bottom surface of the lower truss.

18. A method of using the rail-free hydraulic lifting platform of claim 10, the method comprising:

driving the three parallel hydraulic cylinders to move synchronously via the hydraulic pump station to lift the lifting platform;

when the lifting platform reaches to a predetermined floor, pushing out the footstep assembly arranged on the bottom of the lifting platform by means of the upper electric push rod, and then lifting up the footsteps by means of the lifting mechanism in the footstep assembly so that the footsteps are flush with the surface of the bearing platform, and, at that moment, opening the outward-swinging door between the lifting platform and the floor to form guardrails;

opening the annular door so that a person can walk upstairs from the lifting platform via the footstep assembly;

starting the servo motor to drive the rotating platform to rotate when a pressure sensor arranged on the lifting platform detects the deviation of the center of gravity, so that the rotating platform drives the lower supporting guide frame connected to it to rotate, and thereby the rollers on the bottom of the lower supporting guide frame roll along the circular guide rail fixedly connected to the lower truss and the lower supporting guide frame rotates around the center of rotation to an angle corresponding to a direction opposite to the deviation position of the center of gravity; and driving the eccentric load counterweight by means of the lower electric push rod to move, so that the counterweight blocks are driven by the counterweight wheels to move in the extending/retracting direction of the lower electric push rod, thereby balancing the center of gravity and eliminating the eccentric load of the platform.

* * * * *